US007389814B2

(12) United States Patent
Irwin, Jr.

(10) Patent No.: US 7,389,814 B2
(45) Date of Patent: Jun. 24, 2008

(54) HEAT EXCHANGE COMPRESSOR

(75) Inventor: Charles Chester Irwin, Jr., Grapeland, TX (US)

(73) Assignee: ABI Technology, Inc., Houston, TX (US)

( * ) Notice: Subject to any disclaimer, the term of this patent is extended or adjusted under 35 U.S.C. 154(b) by 794 days.

(21) Appl. No.: 10/660,725

(22) Filed: Sep. 12, 2003

(65) Prior Publication Data

US 2005/0034852 A1 Feb. 17, 2005

Related U.S. Application Data

(62) Division of application No. 09/975,372, filed on Oct. 11, 2001, now Pat. No. 6,644,400.

(51) Int. Cl.
*F28D 7/02* (2006.01)

(52) U.S. Cl. ..... 166/53; 166/61; 166/90.1; 165/166

(58) Field of Classification Search ..... 166/372, 166/53, 61, 90.1; 165/166
See application file for complete search history.

(56) References Cited

U.S. PATENT DOCUMENTS

| | | | | |
|---|---|---|---|---|
| 4,007,787 | A * | 2/1977 | Cottle | 166/267 |
| 4,272,383 | A * | 6/1981 | McGrew | 210/741 |
| RE37,603 | E * | 3/2002 | Coney | 60/407 |
| 2002/0050345 | A1 * | 5/2002 | Miura et al. | 165/166 |

* cited by examiner

*Primary Examiner*—William P Neuder
(74) *Attorney, Agent, or Firm*—Charles Walter

(57) ABSTRACT

An apparatus and process for simultaneously compressing liquids and gases and exchanging the heat of compression with fluids which may be the same liquids and gasses compressed. An apparatus and process for heating maintenance fluids using heat generated when the lift gas is compressed. The compressor may be used for recovering oil and gas from a subterranean formation wherein the production rate is controlled by the gas pressure at the well head, resulting in very slow strokes or pulses and bubbles of lift gas 500 feet long or longer. It may also be used for well maintenance using cooled injection gas from the well and heated fluids, which also may come from the well and be mixed with the well gas during compression, may be conducted without interrupting production.

60 Claims, 8 Drawing Sheets

HEAT EXCHANGE COMPRESSOR

REFERENCE TO PRIOR APPLICATION

This application is a divisional of U.S. Pat. No. 6,644,400, application Ser. No. 09/975,372, "Backwash Oil and Gas Production", filed Oct. 11, 2001.

FIELD OF THE INVENTION

The present invention relates to a method of pumping crude oil, produce water, chemicals, and/or natural gas using an extremely efficient heat exchanging compressor with a novel internal integrated pump/injection system. The invention further relates to recovery systems that may be integrated in a single component. The invention further relates to oil and gas production systems with reduced environmental impact based on utilization of naturally occurring energy and other forces in the well and the process. The invention further relates to compressors controlled by naturally occurring gas from the well. The invention further relates to the prevention of decreased flow from a well due to corrosion, viscosity buildup, etc. downhole. The invention further relates to more cost-effective oil and gas production systems that costs less to purchase, maintain, and operate.

BACKGROUND OF THE INVENTION

Oil and gas recovery from subterranean formations has been done in a number of ways. Some wells initially have sufficient pressure that the oil is forced to the surface without assistance as soon as the well is drilled and completed. Some wells employ pumps to bring the oil to the surface. However, even in wells with sufficient pressure initially, the pressure may decrease as the well gets older. When the pressure diminishes to a point where the remaining oil is less valuable than the cost of bringing it to the surface using secondary recovery methods, production costs exceed profitability and the remaining oil is not brought to the surface. Thus, decreasing the cost of secondary recovery means for oil from subterranean formations is especially important for at least two reasons:

(1) Reduced costs increases profitability, and (2) Reduced costs increases production.

Many forms of secondary recovery means are available. The present invention utilizes gas lift technology, which is normally expensive to install, operate and maintain, and often dangerous to the environment. Basically, gas lift technology uses a compressor to compress the lifting gas to a pressure that is sufficiently high to lift oil and water (liquids) from the subterranean formation to the surface, and an injection means that injects the compressed gas into a well to a depth beneath the surface of the subterranean oil reservoir.

Since the 1960's gas lift compressors have used automatic shutter controls to restrict air flow through their coolers. Some even had bypasses around the cooler, and in earlier models some didn't even have a cooler. Water wells employing free lift do not cool the compressed air used to lift the water to the surface. Temperature control at this point has never been considered important other than to prevent the formation of hydrates from the cooling effect of the expanding lift gas. Therefore, most lifting has been performed with gas straight from the compressor. The heat of compression in this gas is not utilized effectively and is rapidly dissipated when the lift gas is injected into a well.

Compressors for this service are expensive, dangerous, require numerous safety devices, and still may pollute the environment. Reciprocating compressors are normally used to achieve the pressure range needed for gas lifting technology. Existing reciprocating compressors are either directly driven by a power source, or indirectly driven via a hydraulic fluid. While both are suitable for compressing lifting gas, most prior art reciprocating compressors are costly to operate and maintain. Moreover, existing reciprocating compressors are limited to compressing gases because they are not designed to pump both gas and liquids simultaneously and continuously.

Existing compressors use many different forms of speed and volume control. Direct drive and belt drive compressors use cylinder valve unloaders, clearance pockets, and rpm adjustments to control the volume of lift gas they pump. While these serve the purpose intended, they are expensive and use power inefficiently compared to the present invention. Some prior art compressors use a system of by-passing fluid to the cylinders to reduce the volume compressed. This works, but it is inefficient compared to the present invention.

Another example of wasted energy and increased costs and maintenance is in the way the compressing cylinders are cooled in prior art compressors. All existing reciprocating compressors use either air or liquid cooling to dissipate the heat that naturally occurs when a gas is compressed. The fans and pumps in these cooling systems increase initial costs, and require energy, cleaning, and other maintenance. Prior art reciprocating compressors also require interstage gas cooling equipment and equipment on line before each cylinder to scrub out liquids before compressing the gas.

Another example of the inefficiency of prior art technology relates to current means for separating recovery components. Existing methods employ separators to separate primary components, then heater treaters to break down the emulsions. In some cases additional equipment is required to further separate the fluids produced. In each case, controls, valves, burners and accessories add to the cost, environmental impact and maintenance of the equipment.

Prior art compressors require additional equipment to pump the fluids produced from an oil and gas well from the wellhead through the pipeline to gathering or separation stations. In remote field applications, this additional equipment can be both environmentally hazardous and financially expensive. Such applications usually require such additions as "Blow-cases" or pumps. The present invention is capable of pumping these fluids directly, automatically, and at much lower cost.

SUMMARY OF THE INVENTION

The present invention is referred to herein as the HEAT EXCHANGE COMPRESSOR or "HEC". The HEC was developed in connection with the "Backwash Production Unit" or "BPU", U.S. Pat. No. 6,644,400 filed Oct. 11, 2001 and issued Nov. 11, 2003 which is hereby incorporated herein by reference. It was also developed in connection with the "THERMODYNAMIC RECOVERY SYSTEM or "TRS" which is the subject matter of another divisional of U.S. Pat. No. 6,644,400, U.S. patent application Ser. No. 10/660,427, which is hereby incorporated herein by reference. The following disclosure sets forth the unique and innovative features of the HEC, describes a use of the HEC in the context of a BPU, and illustrates how the HEC provides the ability to recover and transfer crude oil and natural gas from a subterranean formation well bore into a pipeline without additional equipment. The method may include receiving natural gas and produced fluids from well into the pump cylinder(s) indirectly via a BPU vessel in which they are installed, elevating pressure of the gas, oil, water and/or a mixture of them to a point that cylinder contents can flow into a pipeline.

In this context, the HEC is particularly attractive for enhancing production of crude oil in that the compression and pumping rates are controlled by wellhead pressure. In particular, the greater the wellhead pressure, the faster the HEC compresses and pumps. If the wellhead pressure falls to zero or a preset limit, the HEC automatically stops compressing and pumping. If the well resumes production, the HEC resumes operation.

The HEC is also particularly attractive for cost-effective production because it greatly reduces the cost of compressing the lifting gas and separating the components produced by the well. This is achieved by simplifying the design and by utilizing energy from the other components of the system that would otherwise be lost by prior art compressors. Where the prior art uses gas compressors and pumps, the HEC pumps both gas and liquids simultaneously. Where prior art compressors require coolers and fans, the HEC dissipates the heat of compression by using it in separating the fluids from the subterranean formation for cooling. Where the prior art uses special control and accessories to control volume as well as pumping and compression speed, the HEC is controlled by the well head pressure. Where the prior art requires scrubbers to prevent fluids from entering the compression cylinders, the HEC function normally with fluids present. Where the prior art continues to use the same energy when production falls, the HEC automatically adjusts its stroke length and pumping rates to match the lower level of recovery.

Integrating HEC and BPU technology eliminates sealing packing, and therefore has substantially fewer moving parts than prior art technology. This reduces the danger of operating the recovery system and further reduces both initial costs as well as maintenance and operation costs. Another advantage of the HEC is that its power source and directional control can be remotely located, thereby reducing maintenance and downtime.

Another extremely attractive aspect of the HEC is that it can be safely installed at the wellhead. Shorter piping requirements, reduced pressure differentials, the lack of danger from burners, and the reduced danger from electrical sparks all contribute to the HEC's safety.

Where the embodiments of the present invention are described in a backwash production context, it will be understood that it is not intended to limit the invention to those embodiments or use in that context. On the contrary, it is intended to cover all applications, uses, alternatives, modifications, and equivalents as may be included within the spirit and scope of the invention as defined by the appended claims.

DESCRIPTION OF THE INVENTION

The HEC is designed primarily for oil and gas recovery from small or low volume producing wells where some natural gas is recovered and gas lift may be used to recover crude oil from a subterranean formation. In what follows "recovery" refers to the process of bringing oil and natural gas to the well surface whereas "production" refers to the portion of recovered oil and natural gas that is stored or sold.

In what follows, "internal liquids" refers to liquids mixed with gasses being compressed and "external liquids" refers to liquids not mixed with gasses being compressed.

Especially in the context of backwash production, the HEC performs many oil field related tasks including hot oil treatment, chemical treatment, flushing, pressure testing, emulsion treatment, and gas and oil recovery using a single piece of equipment. Optimizing and multi-tasking common components ordinarily used in separate pieces of equipment sets the HEC apart from any existing compressor currently in use for crude oil recovery.

The HEC employs technology well known in the art in a novel manner. Free gas lift has been employed for many decades with excellent results, but it is expensive to install and maintain. Working together, the HEC and the BPU greatly improve the efficiency of using free lift by ejecting the gas in very slow strokes (forming pulses). Hot oil treatment is also well known in the art, but has the disadvantages described previously. The HEC is capable of pumping gases, fluids, or any combination thereof into the well, thereby permitting cooled, pressurized gas lift and bore hole treatment with hot oil simultaneously. Separation equipment for the oil and gas recovered at the wellhead, integrated within a single piece of equipment, permits the HEC to switch modes from a lifting system to a pipeline selling mode and back again automatically. When more gas than is needed for lifting is recovered from the well, the invention sends the excess into a collection system or a pipeline. As oil is recovered from the subterranean formation, it is heated to facilitate separation and recovered for storage or sale. Moreover, the invention can be outfitted with metering to monitor dispersal to the end user.

Figure 1:
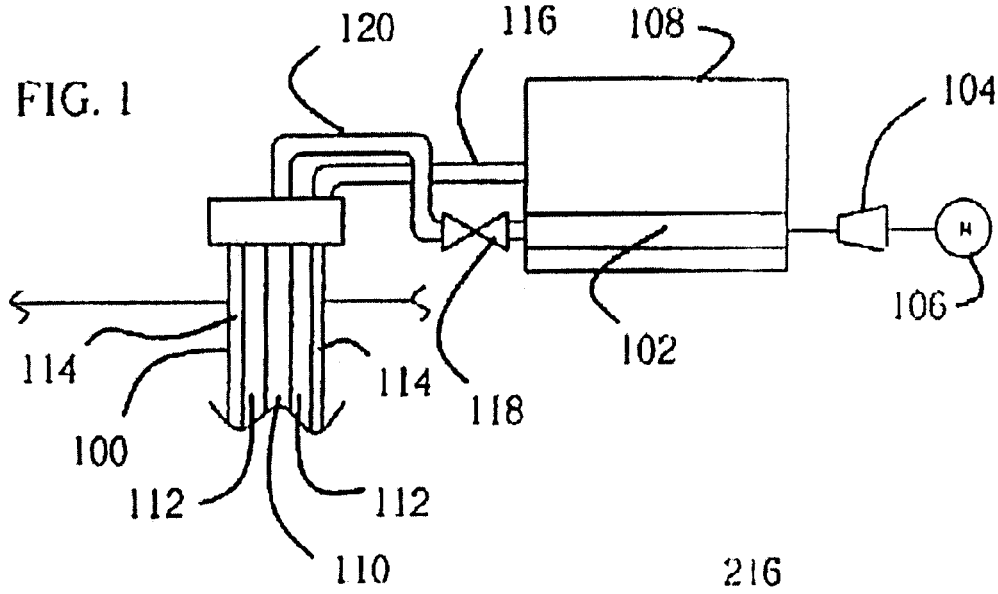
FIG. 1. Schematic Illustration of the HEC as a component in a backwash production context.

An important use of the HEC is in the context of using gas to lift oil and water (liquids) from a subterranean formation for storage or sale. FIG. 1 illustrates such use schematically by depicting the roll of the HEC components therein. Thus, FIG. 1 comprises well 100, compressor 102, pump 104, power supply 106, and separator 108. Well 100 comprises injection chamber 110, lifting chamber 112, and casing chamber 114. The HEC components in FIG. 1 include compressor 102, pump 104, power supply 106 and separator 108. Compressor 102 comprises at least two compressing units, depending on the depth of the well and other recovery requirements. For example, additional cylinders may be added for wells capable of greater production, and a higher pressure cylinder may be added to obtain higher pressures of lift gas that may be necessary for efficient recovery from deep wells or for well maintenance. Pump 104 may be a hydraulic pump capable of pumping sufficient hydraulic fluid to compress lift gas for well 100 using compressor 102. Power supply 106 may be an electric motor or natural gas engine capable of powering pump 104. Separator 108 comprises a means of separating gas, crude oil, and water, and contains compressor 102.

As illustrated in FIG. 1, crude oil, gas and water from well 100 may be piped to separator 108 via inlet 116. Gas at wellhead pressures in separator 108 supplies the lift gas to be compressed in compressor 102, which may be used as lift gas or stored or sold as production gas, supply gas for pressure monitoring information, and fuel for power supply 106. Oil in separator 108 supplies heated oil for injection into well 100, crude oil produced for storage or sale, and coolant for compressor 102. Water in separator 108 supplies heated water for injection into well 100 and coolant for compressor 102. Liquids may be injected after adding chemicals via valve 118. Power supply 106 supplies the power for pump 104, which moves the fluid that powers compressor 102. Compressor 102 compresses gas from the wellhead pressure to the pressure necessary for lifting liquids through well 100 and supplies heat to the surrounding liquids in separator 108.

Figure 2:
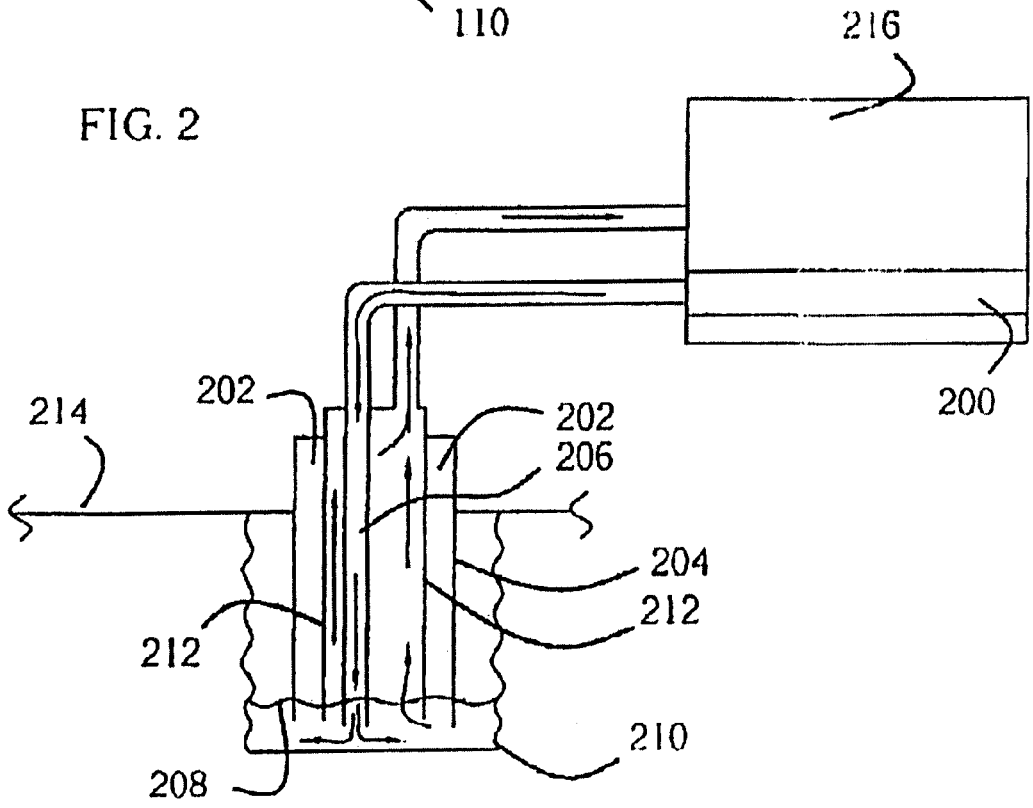
FIG. 2. Illustration of how the HEC compresses gases for lifting and production.

FIG. 2 further illustrates the use of the HEC components (compressor 200 and separator 216) in the backwash production context. In the backwash embodiment illustrated in FIG. 2, cooled compressed gas is injected from compressor 200 into bore hole 202 of well 204 to the bottom of tubing 206, which is down hole 202 sufficiently far to be immersed in liquid 208 in subterranean formation 210. When the compressed gas reaches the bottom of tubing 206, it escapes into casing 212 in hole 202. Since the compressed gas is lighter than liquid 208, the gas rises through liquid 208 as bubbles. During its trip upward through casing 212, the surrounding pressure decreases and the bubbles become larger. As is well known in the art, this action causes the gas to lift liquids above it toward well surface 214. When the bubbles and lift liquids reach surface 214, they enter separator 216, which also houses compressor 200. Optionally, compressor 200 may be used to simultaneously inject heated liquids recovered from well 204 back into well 204 for maintenance thereof.

Figure 3:
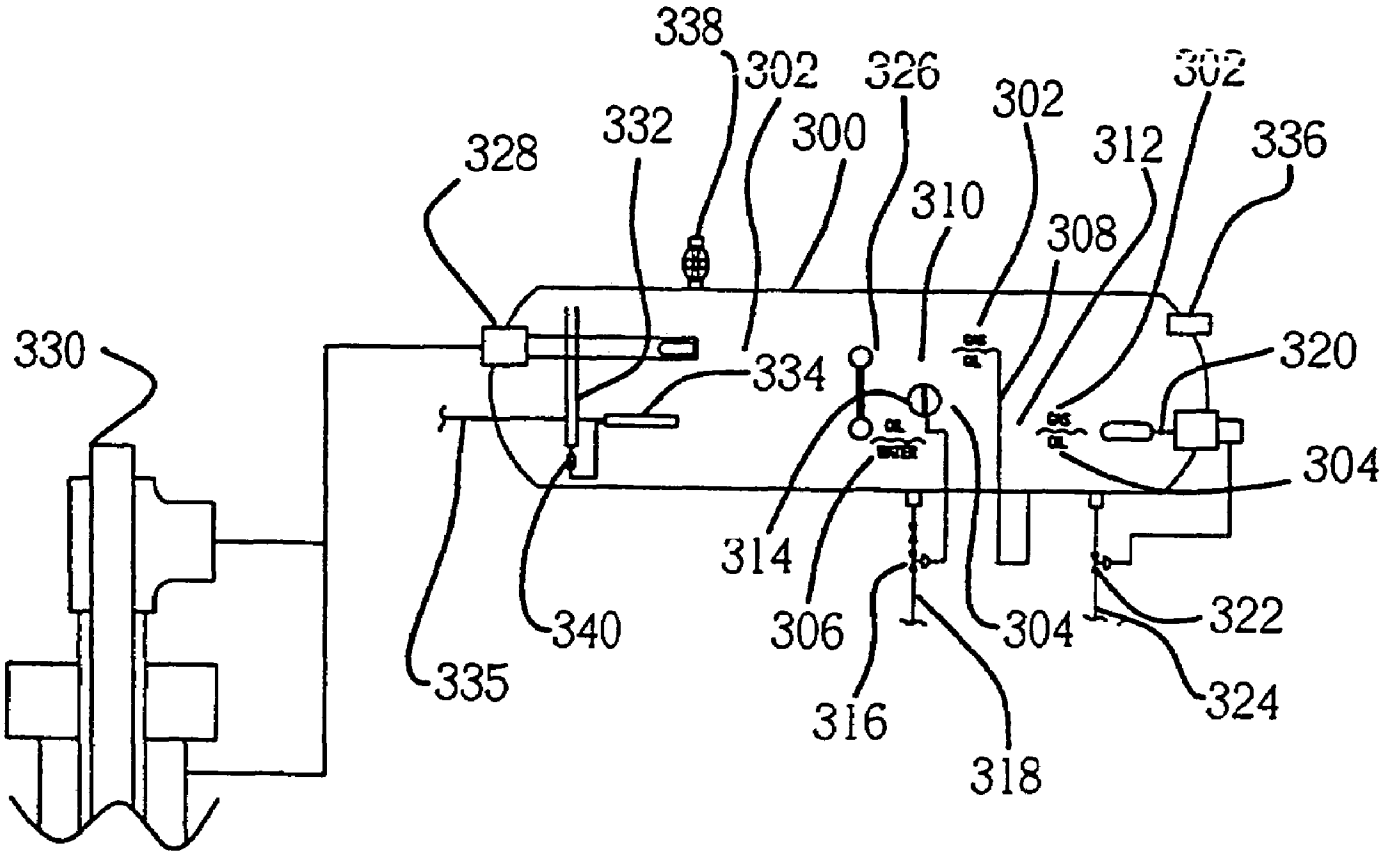
FIG. 3. Illustration of the HEC using a BPU oil/gas/water separator.

FIG. 3 illustrates an embodiment of a separator serving as the immersion vessel for a HEC compressor when it is used in the backwash production context. The separator technology shown is well known in the art (See, for example, the 3-phase horizontal separator available from Surface Equipment Corporation). Tank 300 in FIG. 3 holds a mixture of water, oil and gas, which layer according to their densities, with gas in top layer 302, oil in middle layer 304, and water in bottom layer 306. In the embodiment illustrated in FIG. 3, tank 300 is divided by weir 308 into 3-phase section 310 to the left (3-phase side) of weir 308 and 2-phase section 312 to the right (2-phase side) of said weir. Section 310 may contain gas, oil and water whereas section 312 may contain only gas and oil. Water/oil level control means 314, which may be a Wellmark level control device or other equipment well known in the art, detects the water/oil interface level in section 312 of tank 300. Means 314 ensures that the water level in section 312 does not exceed the height of weir 308. If the water level exceeds a level set by means 312, water dump valve 316 opens, thereby removing water from tank 300 via water outlet 318 until the water returns to the set level, at which time means 314 causes valve 316 to close. Said water may be cycled for injection, with or without added chemicals, for well maintenance, or stored. Oil/gas level control means 320, which may also be a Wellmark level control device or other equipment well known in the art, detects the gas/oil interface level in section 312 of tank 300. The purpose of means 320 is to control the oil level in tank 300. If the oil level exceeds a level set by means 320, oil dump valve 322 opens, thereby removing oil from tank 300 via oil outlet 324 until the oil returns to the set level, at which time means 320 causes valve 322 to close. Said oil may be cycled for injection and well maintenance, or stored or sold. Sight glass 326 provides the user with a means for visually inspecting the levels of water and oil in tank 300.

Tank 300 also includes inlet 328 from well 330, line 332 from the top (gas phase) portion of tank 300 to compressor 334, gas outlet 335 from compressor 334, and instrument supply gas outlet 336. A sufficient volume of gas from layer 302 travels via line 332 to compressor 334 where it is compressed for injection into well 330 or sale. Gas from layer 302 exiting tank 300 via outlet 336 may be used to control instrumentation of the present invention.

Compressor 334 comprises at least two compressing units, depending on the depth of the well and other recovery requirements. For example, additional cylinders may be added for wells capable of greater production, and a higher pressure cylinder may be added to obtain higher pressures of lift gas that may be necessary for efficient production from deep wells or for well maintenance.

Recovery using the embodiment illustrated in FIG. 3 may be facilitated by turbocharger or blower 338, which may reduce the pressure in tank 300 and well 330 without affecting the pressure between the gas in line 332 and compressor 334. Spring loaded check valve 340 may be used to limit the flow of gas to compressor 334 when the wellhead pressure is low.

Figure 4:
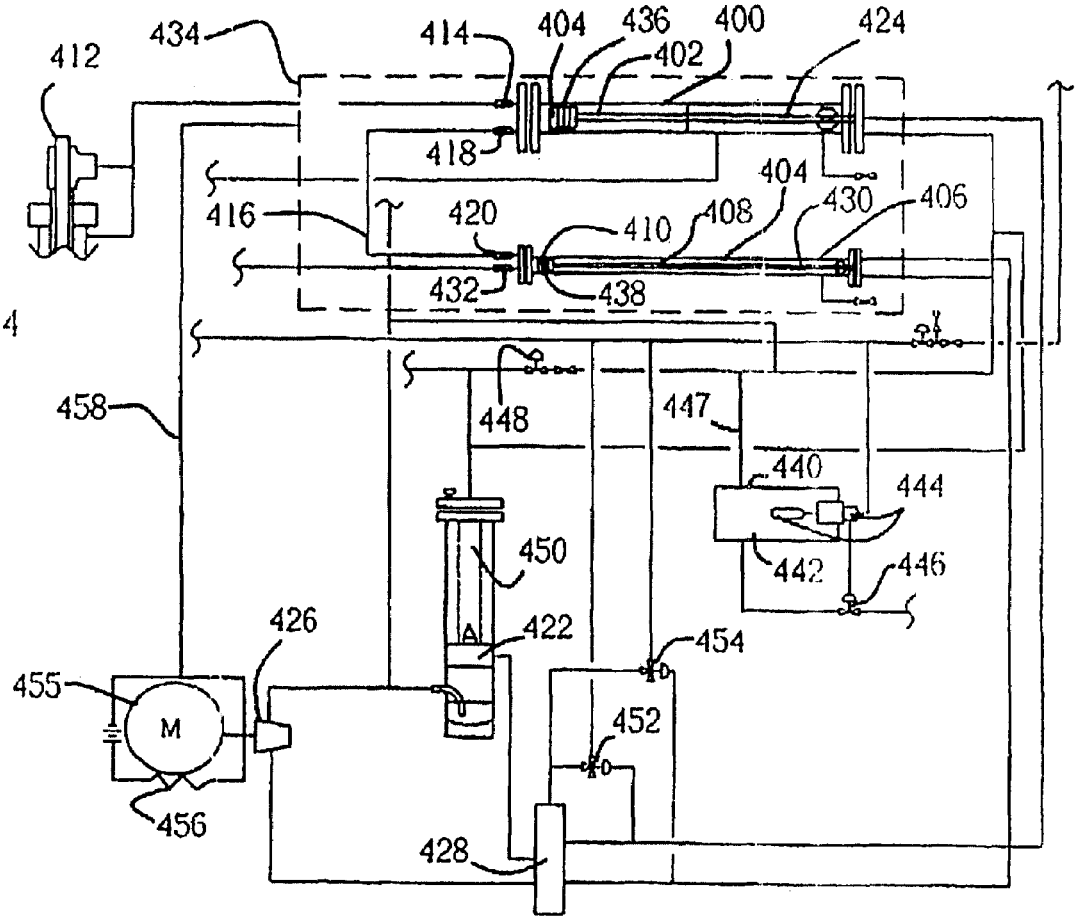
FIG. 4. Illustration of the HEC used as a compressor in a backwash production context.

FIG. 4 illustrates a preferred embodiment of the HEC in a backwash production context. In FIG. 4 low pressure cylinder 400 contains low pressure piston 402 and low pressure piston head 404, and high pressure cylinder 406 contains high pressure piston 408 and high pressure piston head 410. Both cylinders 400 and 406 may pump liquids as well as gases. The purpose of cylinder 400 is to compress gas to an interstage pressure, and the purpose of cylinder 406 is to further compress said gas to a pressure sufficient to lift liquids as illustrated in FIG. 2. Accordingly, cylinder 406 has a smaller radius than cylinder 400. As described above, cylinders 400 and 406 not only pump gases, but may also pump liquids, for example, for injecting hot liquids for well maintenance.

Both pistons 402 and 408 are shown in FIG. 4 in their respective cylinders before gas has been admitted therein. Natural gas from well 412, which may be mixed with liquids in cylinder 400 as described above, is permitted to enter cylinder 400 via first cylinder inlet valve 414, intercylinder piping 416 via first cylinder outlet valve 418, and cylinder 406 via second cylinder inlet valve 420, thereby causing pistons 402 and 408 to begin their stroke by displacing them to the right in cylinders 400 and 406, respectively in FIG. 4. When sufficient gas has been admitted into said cylinders and intercylinder piping to provide gas compressed to the desired interstage pressure, valve 414 closes, and fluid, which may be hydraulic fluid, crude oil or engine oil, from reservoir 422 is pumped into ram portion 424 of cylinder 400 by pump 426 via directional control valve 428, causing piston 402 to move to the left and thereby compressing said gas in said cylinders and intercylinder piping. When said gas in said cylinders and piping reaches the desired interstage pressure, valve 420 closes, valve 428 switches flow of said fluid from cylinder 400 to cylinder 406, and said fluid from reservoir 424 is pumped into ram portion 430 of cylinder 406 by pump 426, causing piston 408 to move to the left and thereby further compressing said partially compressed gas in cylinder 406. Simultaneously, when valve 428 switches, said interstage pressure of said gas in cylinder 400 causes piston 402 to move back to the right in cylinder 400 in FIG. 4. When said gas in cylinder 406 is compressed to the desired pressure for lifting liquids from a subterranean formation, second cylinder outlet valve 432 opens and said compressed gas leaves cylinder 406 and may be used as lift gas for lifting liquids through well 412 as illustrated in FIG. 2 or it may be stored or sold. As described above, the entire process described in this paragraph may take place with liquids mixed with the gas undergoing compression. Moreover, heat from compressions in cylinders 400 and 406 is absorbed in separator 434. Gases that leaks past piston head rings 436 and 438 may be scavenged from said ram portions of cylinders 400 and 406 and recycled to separator 434 or to cylinder 406, where they may be compressed during the next stroke.

Slow stroke compression in cylinders 400 and 406 permit cylinder 400 to act as a charging pump for cylinder 406 and automatically changes the stroke of piston 408 as needed for production from well 412.

Cylinders 400 and 406 are lubricated by the fluid from reservoir 422. Contaminating liquids which may inadvertently mix with said fluid may be removed by means well known in the art, using, for example, blow case/separator 440. In the embodiment shown in FIG. 4, fluid contaminated with water cycles through oil/water separator 442 wherein oil/water interface level control 444 is used to control the level of water. Water may be removed from the bottom of separator 442 via dump valve 446 when the water level increases over the threshold set by control 444. Oil may be removed from the top of separator 442 via line 447 and pressure regulator 448 to filter 450, which is also used to filter fluid cycled back from said ram portions of cylinders 400 and 406 via valve 428, monitor levels of said fluids, and shut down pump 426 if said fluid levels are too low.

When fluid is flowing from valve 428 to cylinders 400 and 406 said flow may be controlled by directional control pilot valves. For example, in the embodiment illustrated in FIG. 4, pressure of fluid flowing from valve 428 to ram portion 424 of cylinder 400 may be monitored by a first directional control pilot valve 452, and pressure of fluid flowing from valve 428 to ram portion 430 of cylinder 406 may be monitored by a second directional control pilot valve 454. Valve 428 may thereby be set to trip if pressure is too high thereby stalling the compression strokes.

Moreover, pump 426 may be controlled by the pressure of gas entering cylinder 400. In the embodiment illustrated in FIG. 4, 2-way valve 452, which may be, for example, a Kimray 1" PC valve, is controlled by the pressure of gas entering cylinder 400 such that valve 452 diverts the flow of pump 426 when pressure is too low.

Power source 455, which may be an electric motor or a gasoline or natural gas engine, may be outfitted with spring loaded actuator 456 to reduce engine or motor speed when the HEC is not compressing. In addition, power source 455 may be outfitted with a turbocharger or blower connected via line 458 to separator 434 to reduce the pressure therein without removing the pressure to cylinder 400, but thereby reducing the wellhead pressure over well 412.

Figure 5:
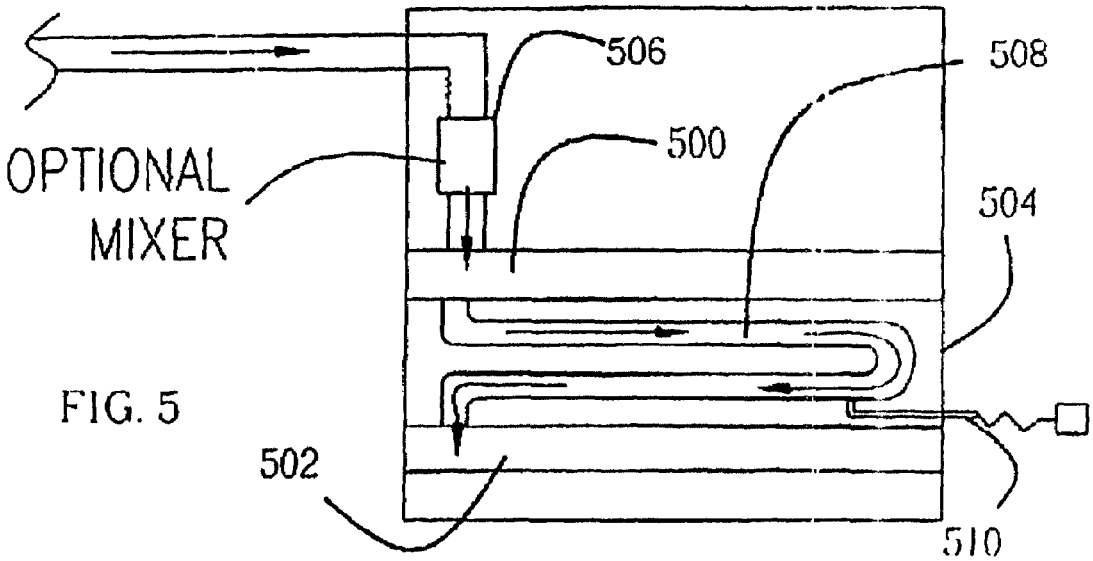
FIG. 5. Illustration of the HEC immersed in a separator.

FIG. 5 further illustrates the HEC components. In FIG. 5 low pressure cylinder 500 and high pressure cylinder 502 are mounted inside separator 504. The lift gas may be combined with liquids in mixer 506 prior to introduction of the gas into cylinder 500. In this disclosure this process of combining the lift gas with liquids is referred to as "natural mixing," and lift gas is referred to as "gas" or "lift gas" whether or not natural mixing has taken place. As illustrated in FIG. 5, the BPU is outfitted with internal heat exchanger 508, which provides an alternative means of heating or cooling the contents of separator 504. In some cases it may be necessary to externally mount additional piping 510 for the compressed gas, with or without liquids to achieve proper heat transfer. FIG. 5 illustrates how heat generated during compression of gas may be utilized to heat oil or water that may be used, for example, for well maintenance. Moreover, the compressed lift gas is cooled, thereby eliminating the adverse effects of injecting hot gases well known in the art.

Figure 6:
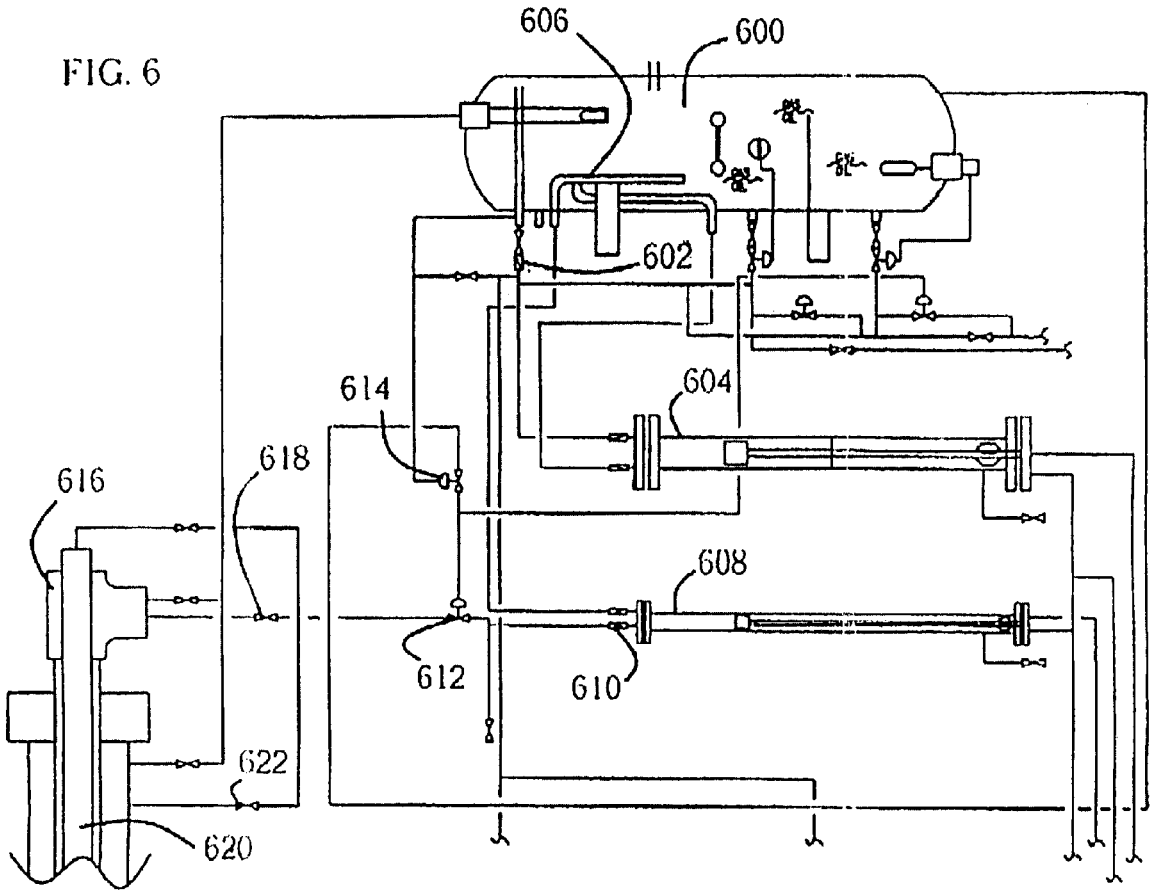
FIG. 6. Illustration of the HEC creating backwash.

FIGS. 5 and 6 illustrate the "backwash" effect for which the BPU invention is named as well as the role of the HEC in that context. As illustrated in FIG. 5, the liquids to be injected may be heated using the heat generated by compressing gas, and then injected, for example, for well maintenance or salt water disposal. In FIG. 6, gas collected in separator 600 flows through spring-loaded low compression cylinder check valve 602 into low compression cylinder 604, intercylinder piping 606, and high compression cylinder 608. The setting for valve 602 controls the minimum pressure that will initiate a compression stroke in cylinder 604. After compression, gas may leave cylinder 608 via high compression cylinder outlet spring-loaded check valve 610. The setting for valve 610 controls the minimum pressure at which gas may leave cylinder 608. The gas leaving cylinder 608 may be vented, or flow to 3-way valve 612, which may be a 1" Kimray valve. The position of valve 612 may be controlled by pilot valve 614, which, in turn is controlled by the gas pressure in separator 600. Depending on the position of valve 612, the gas from cylinder 608 is used as lift gas or sold This feature of the invention is unique in that the wellhead pressure controls recovery. Gas from the well is automatically used to try to increase recovery when recovery is low but is automatically diverted for sale when recovery is normal.

Since the HEC valving is designed for liquid and/or gas flow, cylinders 604 and 608 may pump liquids as well as gases. Therefore, lift gas injected by the present invention may be accompanied by heated water from separator 600 if valve 612 is open, heated oil from separator 600 if valve 614 is open, and both liquids when both valves 612 and 614 are open. This feature prevents any liquid carryover from separator 600 from damaging the invention. In one preferred embodiment of the present invention, valve 602, which may have a load of 10 pounds and valve 610, which may have a load of 80 pounds, permit the HEC to pump as much as 100 gallons per minute of liquid into well 616 with or without lift gas.

This integration of the separator with the pumping cylinders (for example, separator 504 & cylinders 500 and 502 in FIG. 5) and fluid permissive valving (for example, valves 602, 610 and 612 in FIG. 6) sets the HEC apart from all other compressors. As described previously, this design reduces the need for burners, heaters, treating pumps, coolers, fan, scrubbers and many other components normally used for oil and gas production.

As described above, injection of hot gases to lift liquids from subterranean formations is well known in the art. However, since natural gas is a poor carrier of heat, the heat carried by injected gas dissipates within the first few feet where it flows down the well hole. As illustrated in FIG. 6, the HEC avoids this problem during backwash production by pumping heated liquids from separator 600 through an injection valve 618 down injection tubing 620 in well 616 following natural mixing. The liquids mixed with the lift gas forms a film inside tubing 620, thereby warming it and reducing the cooling effect of the expanding lift gas.

The backwash capability also permits the unit to backwash heated liquids from its separator directly into either the casing side or the injection tubing of well 616. This is illustrated in FIG. 6 wherein liquids heated in separator 600 flows directly to tubing 620 via tubing injection valve 618 or directly to the casing side of well 616 via casing injection valve 622. This arrangement permits the invention to remove paraffin buildup and otherwise maintain the well hole by injecting hot liquids without interrupting production. Alternatively, valves 618 and 622 may be used to inject water, for example, to dissolve downhole salt buildup.

Figure 7A:
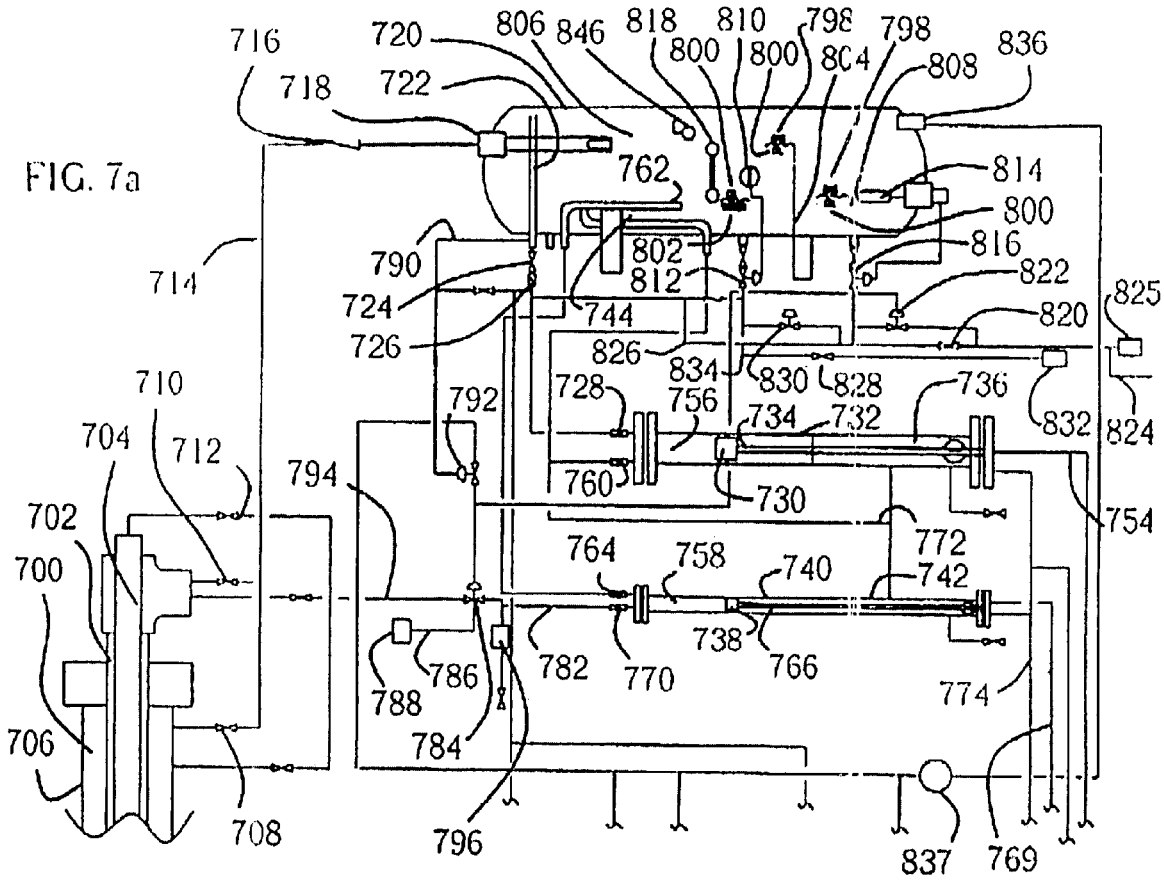
FIG. 7. An embodiment of the HEC in a backwash context.
Figure 7B:
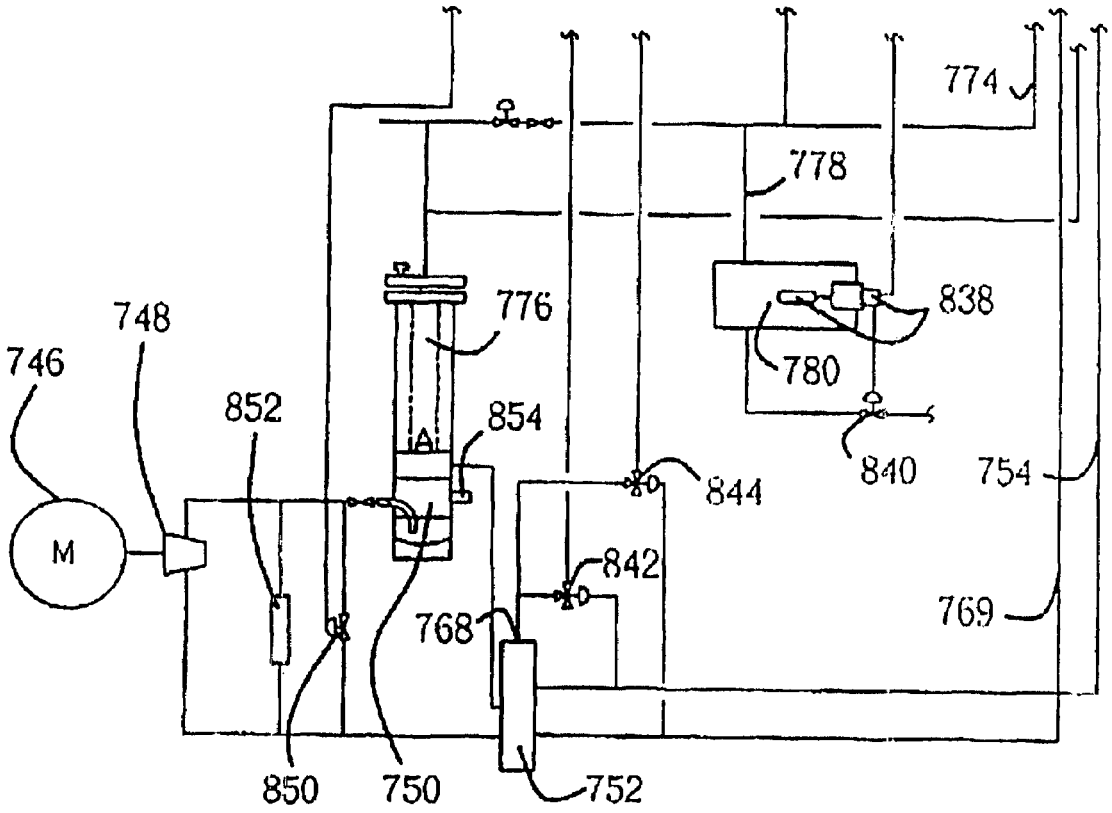

In the embodiment of the HEC illustrated in FIG. 7, gas from casing 700, recovery tubing 702, and injection tubing 704 of well 706 flows via well casing output valve 708, recovery tubing well output valve 710, and injection tubing well output valve 712 into well output line 714 and thence into separator input check valve 716 to recovery inlet 718 of separator tank 720 at separator pressures in the range 40 PSIG. Said gas enters separator gas outlet line 722, which is installed vertically in tank 720, and flows through separator gas outlet valve 724, spring loaded check valve 726, and low compression cylinder inlet valve 728 to low compression cylinder 732. The pressure from said gas entering cylinder 732 displaces head 730 of low compression piston 734 in cylinder 732 to the right into ram portion 736 of cylinder 732 and head 738 of high compression cylinder 740 into ram portion 742 of cylinder 740. When sufficient gas has entered said cylinders and intercylinder piping 744 to provide gas compressed to the desired interstage pressure, valve 726 closes. Engine 746, which may be an electrical motor, natal gas engine, or the like, supplies power to pump 748, which may be a hydraulic pump. Pump 748 pumps fluid, which may be hydraulic fluid, crude oil, engine oil, or the like, from fluid source 750 at pressures in the range 3000 PSIG through directional control valve 752 into portion 736 of cylinder 732 on the opposite side of head 730 via low pressure cylinder fluid inlet line 754, thereby compressing gas in compression chamber 756 of cylinder 732, intercylinder piping 744 and compression chamber 758 of cylinder 740 to a pressure in the range 100-350 PSIG while displacing gas from cylinder 732 through low compression cylinder gas outlet check valve 760. The partially compressed gas leaving cylinder 732 is cooled inside internal heat exchange unit 762, which is part of piping 744 immersed in tank 720. As described above, said gas has entered compression chamber 758 of cylinder 740 via high compression cylinder input valve 764 during compression in cylinder 732, thereby displacing high compression piston 766 to the right into ram portion 742 of cylinder 740. When piston 734 has completed its compression stroke, pressure switch 768 for cylinder 732 is tripped, thereby changing the position of valve 752 to permit flow of fluid into ram portion 742 of cylinder 740. Pump 748 pumps fluid at pressures in the range 3000 PSIG through valve 752 and line 769 into ram portion 742 of cylinder 740 on the opposite side of head 738, thereby compressing gas in compression chamber 758 to the pressure necessary to lift liquids from the subterranean formation, and thence displaces said gas out through high compression cylinder gas outlet spring loaded check valve 770. Meanwhile, depending on the wellhead pressure and the spring load in valve 726, additional gas from well 706 may refill chamber 756 of cylinder 732 and piping 744, thereby displacing piston 734 to the right into ram portion 736. When valve 770 opens, thereby enabling the compressed gas to leave chamber 758 of cylinder 740, said new gas from well 706 also refills chamber 758 of cylinder 740, thereby displacing piston 766 to the right into ram portion 742. When piston 766 reaches the end of its compression stroke, valve 752 switches back to the position wherein fluid is pumped into cylinder 732 by pump 748, thereby initiating the next BPU and HEC compression stroke, as described above. Valve 752 also enables cylinders 732 and 740 to empty fluids displaced from their ram portions 736 and 742 as described above. Oil and gas that may leak across piston heads 730 or 738 into ram portions 736 or 742 may be returned to cylinder 732 via oil and gas recycle line 772 and valve 728. Alternatively, gas that may leak across piston heads 730 or 738 may be used as fuel after recovery through gas recycle line 774 and fluid filter system 776. In another alternative, oil and water that may leak across piston heads 730 or 738 may be directed through oil and water recovery line 778 to oil/water separator 780, and the oil recovered there from.

In the preferred embodiment illustrated in FIG. 7, valve 770 may be a spring loaded check valve set for an 80 pound load. In that embodiment, only when said gas pressure in compression chamber 758 exceeds 80 PSIG, said gas may flow through high pressure gas outlet line 782 to 3-way motor valve 784. If this condition is met, valve 770 opens after compression in chamber 758 is complete, and the compressed gas may be diverted through valve 784 to metered pipeline 786 or storage tank 788, or said compressed gas, with or without natural mixing with liquids, may be injected into well 706. The position of valve 784 may be controlled by the pressure of gas leaving tank 720 at outlet 722 via line 790 through gas pilot valve 792. When the pressure of gas leaving tank 720 equals or exceeds a threshold value which may be set by the user, pilot valve 792 permits the flow of instrument gas from tank 720 to valve 784, thereby setting valve 784 to permit the flow of compressed gas to pipeline 786 or tank 788. Alternatively, when said pressure becomes less than said threshold value, pilot valve 792 blocks the flow of instrument gas to valve 784, thereby switching valve 784 to block flow to pipeline 786 or tank 788 while still permitting the flow of compressed gas from cylinder 740 to injection line 794 for injection as lift gas into well 706. Optional signal shut-off 796 may be included between valve 770 and valve 784 to provide a means of shutting off lift gas during injection of hot liquids from cylinder 740.

Specifically, lift gas may be injected in injection tubing 704, where said gas travels down to the bottom of said tubing and bubbles out through liquids resting in the subterranean formation. In the preferred embodiment illustrated in FIG. 7, the gas temperature and the liquid temperatures are similar. As the gas bubbles rise, they expand and cool. This cooling effect is offset by the density of the surrounding liquids. At this point a recovery system is capable of capitalizing on the HEC's inherent ability to heat liquids in tank 720 and use the heat as needed for efficient oil recovery. In particular, heated liquids may be pumped from tank 720 into tubing 704 as needed to offset the cooling effect described above. In this preferred embodiment of the invention, the heated tubing helps maximize the expansion effect of the bubbles as they continue to rise and expand, thereby starting the liquid lift through recovery tubing 702. Both tubing 702 and 704 may be installed as open ended tubing as required for the liquid level in the subterranean formation. When the lifted liquids reach the surface, they enter tank 720 as described above.

In the preferred embodiment illustrated in FIG. 7, the gas, oil and water from the subterranean formation are separated in tank 720. Tank 720 in FIG. 7 holds a mixture of water, oil and gas, which layer according to their densities, with gas in top layer 798, oil in middle layer 800, and water in bottom layer 802. In the embodiment illustrated in FIG. 7, tank 720 is divided by weir 804 into 3-phase action 806 to the left of weir 804 and 2-phase section 808 to the right of said weir. Section 806 may contain gas, oil and water whereas section 808 may contain only gas and oil. Water/oil level controller 810, which is a device well known in the art such as a Cemco liquid level controller, detects the water/oil interface level in section 806 of tank 720. When the water/oil interface level equals or exceeds a threshold value which may be set by the user, instrument gas flowing through controller 810 causes injection water dump valve 812 to open, thereby removing water from tank 720. On the other hand, when the interface level is less than said threshold value, instrument gas stops flowing through controller 810, thereby causing dump valve 812 to close. Similarly, oil/gas level controller 814 detects the oil/gas interface level in section 808 of tank 720. When the liquid level equals or exceeds a threshold value which may be set by the user, instrument gas flowing through controller 814 causes oil dump valve 816 to open, thereby removing oil from tank 720. On the other hand, when the liquid level is less than said threshold value, instrument gas stops flowing through controller 814, thereby causing dump valve 816 to close. Sight glass 818 provides the user with a means for visually inspecting the levels of water and oil in tank 720. When manual oil valve 820 is open or when pilot valve 792 is blocking valve 784 so that oil motor valve 822 is open, oil flows from tank 720 to storage tank 824 or metered pipeline 825, but when valve 820 and valve 822 are closed, oil flows into cylinder 732 via oil recycle line 826 and valve 728 for injection into well 706. Similarly, when water manual valve 828 or water motor valve 830 are open water flows from tank 720 to storage tank 832, but when valve 828 and valve 830 are closed, water flows into cylinder 732 via water recycle line 834 and valve 728 for injection into well 706.

Accordingly, valves 792, 784, 820, 822, 828 and 830 operate to control the flow of oil for injection with lift gas as follows:

IF 792=0, 784=0, NO GAS IS BEING RECOVERED 822=0, AND 830=0

IF 820=0, OIL FLOWS FOR INJECTION

IF 820=1, OIL IS BEING STORED

IF 828=0, WATER FLOWS FOR INJECTION

IF 828=1, WATER IS BEING STORED

IF 792=1, 784=1, GAS IS BEING RECOVERED, 822=1, AND 830=1

IF 820=0, OIL IS BEING STORED

IF 820=1, OIL IS BEING STORED

IF 828=0, WATER IS BEING STORED

IF 828=1, WATER IS BEING STORED

This arrangement prevents liquids from tank 720 from being mixed with production gas. It merely requires that an operator keep both manual valves open except during oil or water injection.

Tank 720 also includes instrument supply gas outlet 836. The pressure of supply gas from outlet 836 is regulated by regulator 837, which may be set at 35 PSIG for the embodiment illustrated in FIG. 7. In addition to supplying gas for controllers 810 and 814, said supply gas is used in separator 780 to detect the water/oil interface therein using liquid level controller 838. When the oil/water interface level equals or exceeds a threshold value which may be set by the user, instrument gas flowing through controller 838 causes water dump valve 840 to open, thereby removing water from separator 780. On the other hand, when the interface level is less than said threshold value dump valve 840 closes. In addition to pilot valve 792, supply gas from tank 720 is also used in low fluid pressure pilot valve 842 and high fluid pressure pilot valve 844 which control valve 752. In the embodiment illustrated in FIG. 7 the threshold supply gas pressure that opens valve 752 may be set at 10 PSIG.

Gas from tank 720, in addition to being used for lifting and for sale, may also be used, for example, as fuel for engine 746, or other purposes. Oil, in addition to being used for injection and well maintenance and for sale, may also be used as coolant for cylinders 732 and 740, or it may be used, for example, as fluid for pump 748, or other purposes. Water, in addition to being used for injection and well maintenance, may also be used as coolant for cylinders 732 and 740.

Gas pressure in tank 720 may be limited by separator relief valve 846, which may be set at 125 PSIG for the embodiment illustrated in FIG. 7. Control of pump 748 is coordinated with control of compression by cylinder 734 by the gas pressure in tank 720. If the pressure between valves 724 and 726 is less than the amount set for valve 726, valve 726 remains closed, and compression in cylinder 734 stops. Simultaneously, the pressure between valves 724 and 726 control 2-way motor valve 850 such that when said pressure is less than an amount which may be set by the user, for example, 10 PSIG, valve 850 is open and fluid cannot flow to valve 752 or cylinders 732 and 740. When said gas pressure exceeds the amount set by the user, valve 850 closes, and pump 748 pumps fluid to valve 752. For the embodiment illustrated in FIG. 7, valve 726 and valve 850 may be set at 10 PSIG so that the flow of hydraulic fluid through valve 752 cannot occur when the wellhead pressure is insufficient for compression. Pump 748 then cycles fluid under control of relief valve 852 without pumping said fluid to ram portions 736 and 742 for compression. In the embodiment illustrated in FIG. 7, pump 748 is further protected by low level shutdown 854 in fluid filter system 776. Moreover, when engine 746 is a gas powered engine, engine temperature and oil pressure may be controlled by shutdown mechanisms well known in the art. In another embodiment of the invention, pump 748 and engine 746 may be remotely located away from the recovery area, and may serve more than one production unit.

Figure 8:
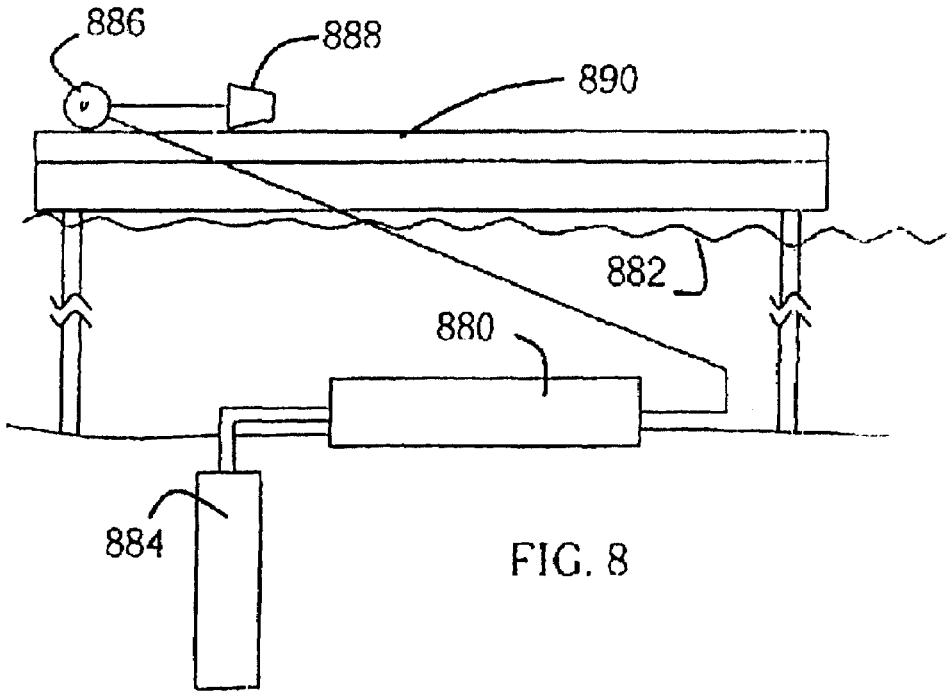
FIG. 8. An illustration the HEC used in an underwater backwash production context.

FIG. 8 illustrates how the HEC a waterproof recovery system 880 may be operated submerged in water 882 near underwater well 884 using engine 886 and pump 888, both of which are located above the surface of water 882 on platform 890.

Figure 9:
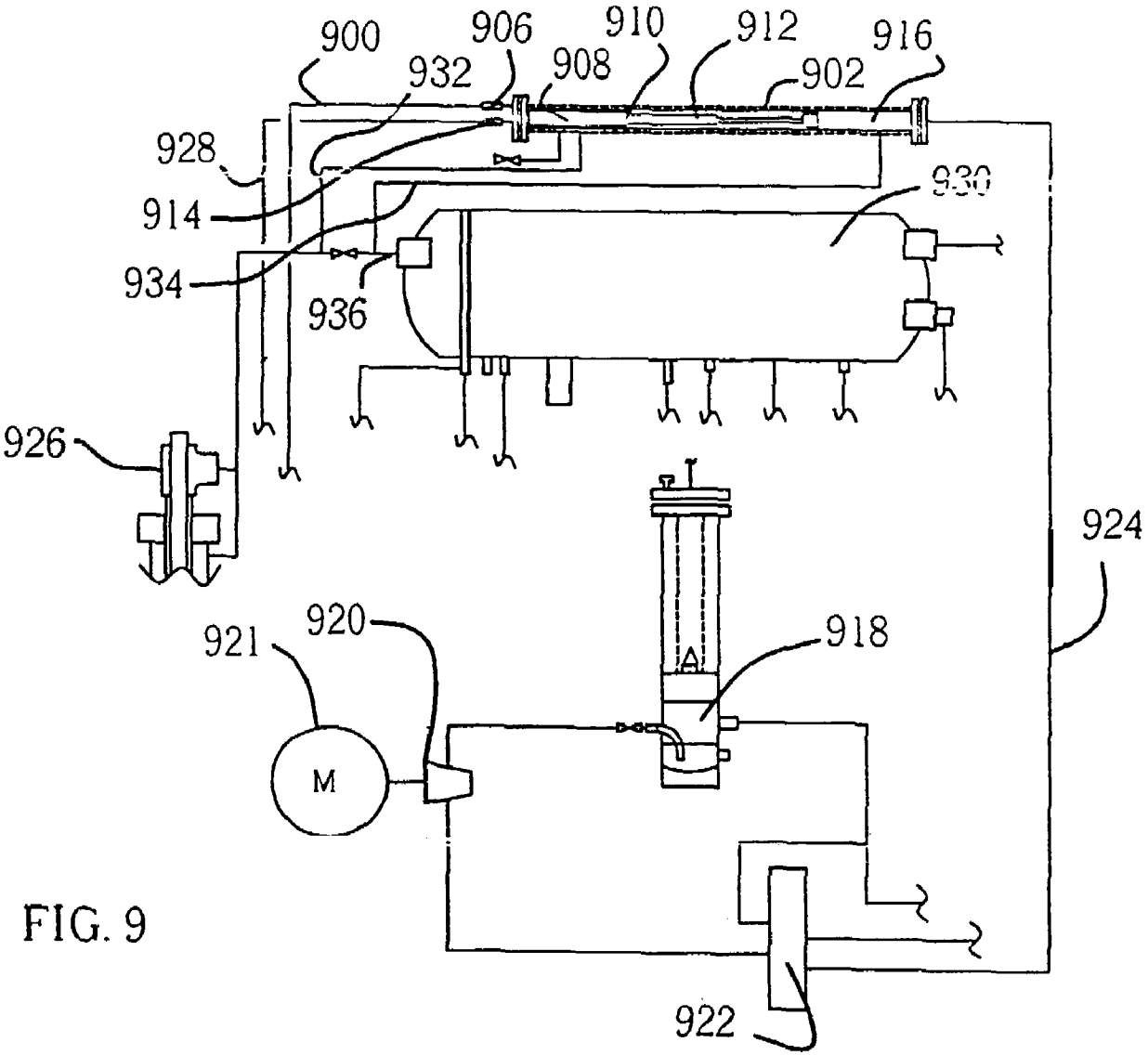
FIG. 9. An embodiment of a HEC in a backwash production context requiring higher pressure gas injection.

FIG. 9 illustrates an embodiment of the invention with one additional cylinder added for applications requiring higher lift gas pressure or for well maintenance with high pressure gas. In FIG. 9, compressed gas from high pressure gas outlet line 900 of the 2-cylinder HEC in FIG. 7 is diverted to supplemental cylinder 902 via line 900 and gas inlet valve 906. Cylinder 902 comprises compression chamber 908 which is to the left of piston head 910 of piston 912. In FIG. 9 gas outlet valve 914 is initially closed, piston 912 is initially located midway in cylinder 902, and ram portion 916 of cylinder 902 is to the right of piston 912. When said compressed gas fills chamber 908, piston 912 is displaced to its rightmost position and valve 906 closes. After cylinder 902 is filled with said compressed gas, fluid is pumped from fluid source 918 by pump 920 and power source 921 through manual control valve 922 via fluid supply line 924 into portion 916 of cylinder 902, displacing piston 912 to the left and thereby compressing said compressed gas further to higher pressure, which may be required, for example to lift liquids, for well maintenance, and the like. Said gas at said higher pressure may be injected into well 926 via injection line 928 by opening valve 914. After injection, valve 914 closes, valve 906 opens, gas from line 900 entering chamber 908 displaces piston 912 to the right, thereby displacing fluid from portion 916 from cylinder 902. Fluid is again pumped into portion 916, thereby starting the next compression stroke for cylinder 902 as described above. Excess gas from chamber 908 and portion 916 of cylinder 902 may be recycled to separator tank 930 via lines 932 and 934 and recovery inlet 936.

EXAMPLE 1

The average well performs best with 40-60 PSIG back pressure on the lift system. The following example uses 40 PSI as the operating pressure in a BPU using a HEC with two cylinders with 108" strokes and 1.1875" ram cylinder bore radiuses and a 30 gallon per minute hydraulic pump. The low compression cylinder has a bore radius of 4" and the high compression cylinder has a bore radius of 2".

Maximum Ram Pressure Available: 3000 PSIG

Input Pressure to First Cylinder: 40 PSIG
Swept Volume of First Cylinder: 5430 Cubic Inches
Input Volume to First Cylinder: 11.7 Standard Cu.Ft. Gas
Minimum Ram Pressure Required for First Cylinder: 2537 PSIG
Discharge Pressure from First Cylinder: 210 PSIG
Discharge Swept Volume from First Cylinder: 1357.7 Cubic Inches
Minimum Ram Pressure Required for Second Cylinder: 2864 PSIG
Input Volume to Second Cylinder: 2.85 Cubic Feet
Discharge Pressure from Second Cylinder: 1000 PSIG
Discharge Volume from Second Cylinder: 0.631 Cubic Feet Example 1 injects 0.631 cubic inches of compressed lift gas into a well 6 to 8 times per minute, thereby creating a bubble 11.7' long in a 4" ID casing with 2⅜" OD injection tubing each time. As this bubble rises, it increases in size to 207' long.

EXAMPLE 2

The engine in Example 1 controls the pump frequency. Lifting capacity is controlled by the volume of the low pressure cylinder, the pressure ratio, and the number of strokes per time unit. For a gas from the separator at 40 PSIG, a pressure ratio of 4.1, and a frequency of 6 to 8 strokes per minute, the lifting capacity of the unit in Example 1 is 114,180 cubic feet per day. Based on ⅓ HP per gallon per 500 PSI, the power required to lift this volume is 56.57 horsepower (peek load at the end of the stroke) or 33.6 horsepower (average for entire stroke) for both cylinders at maximum operating pressures.

EXAMPLE 3

Over a two hour period during which oil and water are lifted from the well, 40,000 BTU is transferred from the compression cylinders of Example 1 to 4,000 pounds of water in a separator with a three stage capacity of 900 BBL/day, thereby increasing the water temperature 100 degrees F. This hot water is injected into the well for maintenance without interrupting production.

EXAMPLE 4

The following example uses 40 PSI as the operating pressure in a BPU using a HEC with two cylinders with 234" strokes and 1.1875" ram cylinder bore radiuses and a 60 gallon per minute hydraulic pump. The low compression cylinder has a bore radius of 4" and the high compression cylinder has a bore radius of 2".

Maximum Ram Pressure Available: 3000 PSIG
Input Pressure to First Cylinder: 40 PSIG
Swept Volume of First Cylinder: 11,766.86 Cubic Inches
Input volume to First Cylinder: 25.34 Cubic Feet
Minimum Ram Pressure Required for First Cylinder: 2537 PSIG
Discharge Pressure from First Cylinder: 210 PSIG
Discharge Volume from First Cylinder: 6.168 Cubic Feet
Minimum Ram Pressure Required for Second Cylinder: 2864 PSIG
Discharge Pressure from Second Cylinder: 1000 PSIG
Swept Volume of Second Cylinder: 2941.71 Cubic Inches
Discharge Volume from Second Cylinder: 1.366 Cubic Feet Example 4 injects 1.366 cubic feet of compressed lift gas into a well 6 to 8 times per minute, thereby creating a bubble 24.17' long in a 4" ID casing with 2⅜" OD injection tubing. As this bubble rises, it increases in size to 448.5' long.

EXAMPLE 5

For a gas from the separator at 40 PSIG, a pressure ratio of 4.1, and a frequency of 8 strokes per minute, the lifting capacity of the unit in Example 4 is 231,770 cubic feet per day. Based on ⅓ HP per gallon per 500 PSI, the power required to lift this volume is 113.44 horsepower (peek load) or 67.98 horsepower (average load) for both cylinders at maximum operating pressures.

EXAMPLE 6

Over a one hour period during which oil and water are lifted from the well, 65,000 BTU is transferred from compression cylinders of Example 4 to 13,000 pounds of oil in a separator with a three stage capacity of 100 BBL/hour. The oil temperature increases 100 degrees F. This hot oil is injected into the well for maintenance without interrupting production.

EXAMPLE 7

Separator-Heater Vessel Dimensions W/L: 36"/240"
Maximum Ram Pressure Available: 4000

Stage 1 Cylinder
Required Ran Pressure: 3285
Piston Diameter: 12"
Piston Area: 113.14 Square Inches
Ram Diameter: 3.5"
Ram Area: 9.63 Square Inches
Stroke: 108"
Compression Chamber Displacement Volume: 12219.43 Cubic Inches
Stroke/min: 5.5
Ram Displacement Volume: 1039.50 Cubic Inches
Inlet Pressure: 50 PSIG
Maximum Pressure: 340.28
Cylinder Temperature: 346 Degree F.
Volume: 26.06 GPM, 247.15 MCFD
112.97 PEEK HP REQ.

Stage 2 Cylinder
Required Ram Pressure: 3131
Piston Diameter: 6"
Piston Area: 28.29 Square Inches
Ram Diameter: 3.5"
Ram Area: 9.63 Square Inches
Stroke: 108"
Compression Chamber Displacement Volume: 3054.86 Cubic Inches
Stroke/min: 5.5
Ram Displacement Volume: 1039.50 Cubic Inches
Inlet Pressure: 251 PSIG
Discharge Pressure: 1000 PSIG
Maximum Pressure: 1361.11
Cylinder Temperature: 371 Degree F.*
Volume: 26.06 GPM, 246.66 MCFD
Peek HP Required: 107.69
Total HP Required: 76.63
BTU Heat Generation: 2,305,405 Day/Liquid, 1,227,363 Day/Well
Vessel BTU Emission: 6118 BTU/Square Foot
External Cooling: 3868 BTU/Hour
External Tube Area: 1.72 Square Feet
External Tube Length: 78.85'
OD External Tube Size: 1"
Vessel Maximum Duty: 2250 BTU/Square Foot Pump Volume @ 3600: 52 GPM, 3608 RPM: Average Engine Speed
* Based on 140 Degree Vessel Temperature

EXAMPLE 8

Separator-Heater Vessel Dimensions W/L: 24"/180"
Maximum Ram Pressure Available: 4000

Stage 1 Cylinder
Required Ram Pressure: 2544
Piston Diameter: 8"
Piston Area: 50.29 Square Inches
Ram Diameter: 2.4375"
Ram Area: 4.67 Square Inches
Stroke: 108"
Compression Chamber Displacement Volume: 5430.86 Cubic Inches
Stroke/min: 6
Ram Displacement Volume: 504.17 Cubic Inches
Inlet Pressure: 40 PSIG
Maximum Pressure: 371.34
Cylinder Temperature: 346 Degree F.
Volume: 13.79 GPM, 101.30 MCFD
77.46 PEEK HP REQ.

Stage 2 Cylinder
Required Ram Pressure: 2869
Piston Diameter: 4"
Piston Area: 12.57 Square Inches
Ram Diameter 2.4375"
Ram Area: 4.67 Square Inches
Stroke: 108"
Compression Chamber Displacement Volume: 1357.71 Cubic Inches
Stroke/min: 6
Ram Displacement Volume: 504.17 Cubic Inches
Inlet Pressure: 210 PSIG
Discharge Pressure: 1000 PSIG
Maximum Pressure: 1485.35
Cylinder Temperature: 406 Degree F.
Volume: 13.79 GPM, 101.30 MCFD

EXAMPLE 9

Example 8 with a third, high compression cylinder:
87.36 PEEK HP REQ.

Stage 3 Cylinder
Required Ram Pressure: 3740
Piston Diameter: 2"
Piston Area: 3.14 Square Inches
Ram Diameter: 3"
Ram Area: 7.07 Square Inches
Stroke: 96"
Compression Chamber Displacement Volume: 301.71 Cubic Inches
Stroke/min: 6
Ram Displacement Volume: 678.86 Cubic Inches
Inlet Pressure: 1000 PSIG
Discharge Pressure: 8000 PSIG
Maximum Pressure: 1485.35
Cylinder Temperature: 575 Degree F.
Volume: 13.79 GPM, 101.30 MCFD
Fluid Volume Input: 9,000 Maximum Pressure
Water: 18.56 GPM
Total HP Required 65.21
BTU Heat Generation: 328,336 Day/Liquid, 198,355 Day/Well
Vessel BTU Emission: 1743 BTU/Square Foot
Pump Volume: 46.13 GPM, 3194 RPM: Average Engine Speed

EXAMPLE 10

A BPU and HEC designed for 40 PSIG separator and 800 PSIG well continuous operating conditions. These pressures result in a 211 degree increase in temperature per cylinder. For natural gas weighing 58 pounds per thousand cubic feet, the HEC pumps 6,506 pounds of gas per day per cylinder. This amounts to 549,106 BTU per day transferred to the liquids in the separator from cooling the cylinders and gas. If additional heat is required, the exhaust from the engine powering the hydraulic pump and jacket water can be diverted to the unit.

EXAMPLE 11

A pump attached to the separator in the above examples evacuates the gas and pumps them to the low pressure cylinder. The reduced pressure over the well hole accelerates recovery.

The foregoing disclosure and description of the invention are illustrative and explanatory thereof, and various changes in the use, size, shape and materials, as well as in the details of the illustrated construction may be made without departing from the spirit of the invention.

It should be apparent to those skilled in the art that features which have been described in relation to specific embodiments may be included in other embodiments, and that the principles of the various methods of injection and recovery may be applied in other embodiments. Modifications to the embodiments described will be apparent to those skilled in the art.

I claim:

1. The process of using a compressor capable of pumping liquid/gas mixtures to produce compressed gas and heated liquid from said fluid mixtures comprising:

the introduction of said fluid mixture into said compressor, the compression of gasses in said mixture to said compressed gasses, the transfer of at least a portion of the heat of compression to liquids in said mixture with the simultaneous heating of said liquids to heated liquids and cooling of said compressed gasses to cooled gasses, the removal of said cooled gasses and heated liquids from said compressor, and the separation of said cooled gasses and heated liquids.

2. The process of claim 1 wherein said compressed gasses are injected into an oil and gas well as lift gas and said heated liquids are injected into said well for well maintenance without interrupting the injection of said lift gasses.

3. The process of claim 2 wherein said lift gas is natural gas recovered from said well and said heated liquids include crude oil, water or a mixture thereof recovered from said well.

4. A heat exchange compressor for pumping inlet fluids, which may be inlet liquids, inlet gasses or inlet liquids mixed with inlet gasses, with multiple compressing stages capable of pumping said liquids and compressing said gasses wherein the inlet pressure of said gasses controls the stroke frequency of said compressor and the rate of compression of said gasses by varying stroke length.

5. The compressor of claim 4 wherein the composition of said inlet fluids further controls said stroke frequency of said compressor and said rate of compression of said gasses by varying stroke length.

6. A heat exchange compressor for pumping inlet fluids, which may be inlet liquids, inlet gasses or inlet liquids mixed with inlet gasses, with multiple compressing stages capable of pumping said liquids and compressing said gasses wherein the inlet pressure of said gasses further controls said compressor by interrupting compression without interrupting the flow of hydraulic fluid.

7. A heat exchange compressor for pumping inlet fluids, which may be inlet liquids, inlet gasses or inlet liquids mixed with inlet gasses, with multiple compressing stages capable of pumping said liquids and compressing said gasses with a power supply and a compressing means that includes a hydraulic fluid pumping means in fluid communication with a hydraulic fluid reservoir, an inlet compression cylinder with an inlet valve, an outlet valve, and an end plate with openings for said valves, an inlet monitoring means for monitoring the pressure of inlet gasses in said inlet fluids, an outlet compression cylinder with an inlet valve, an outlet valve, and an end plate with openings for said valves, an outlet monitoring means for controlling release of compressed fluids from said outlet compression cylinder, at least one pair of serially-connected compression cylinders comprising a higher pressure compression cylinder, which may be said outlet compression cylinder, and a lower pressure compression cylinder, which may be said inlet compression cylinder, a compression chamber and a ram chamber in each of said compression cylinders, a free-floating shaft and piston in each of said ram chambers for pumping fluids, which may be gasses, liquids or both, an inter-chamber fluid communication means between said compression chambers of said serially-connected compression cylinders, an inter-chamber valving means for controlling said inter-chamber fluid communication means, a ram control means with a ram monitoring means for monitoring hydraulic pressure in said ram chambers and a ram switching means for controlling the flow of hydraulic fluid to said compression cylinders, and a heat exchange means in thermal communication with said compression means wherein the heat of compression generated during compression heats liquids, which may be internal liquids, external liquids, or both, to produce heated liquids.

8. The compressor of claim 7 with said compressing means operating inside a pressure vessel.

9. The compressor of claim 8 with a filtered hydraulic fluid reservoir.

10. The compressor of claim 8 where said pressure vessel is a separator.

11. The compressor of claim 10 wherein said inlet fluids are wellhead fluids lifted from an oil and gas well.

12. The compressor of claim 11 wherein said ram control means includes a directional control valve in fluid and electrical communication with said compression cylinders.

13. The compressor of claim 12 wherein said inlet compression cylinder is in fluid communication with said inlet fluids from said well, and said outlet compression cylinder is in fluid communication with injection tubing in said well during injection and with recovery lines during recovery of excess gas.

14. The compressor of claim 13 with two compression cylinders.

15. The compressor of claim 14 wherein said hydraulic fluid pumping means utilizes the power from said power source by moving the maximum inlet gas volume through said compression cylinders, compressing said maximum inlet gas volume into a first compressed volume, moving said first compressed volume through said outlet compression cylinder, further compressing said first compressed volume into an outlet volume, and discharging said outlet volume through said outlet valve.

16. The compressor of claim 14 wherein said ram control means includes a pressure compensating flow control valve.

17. The compressor of claim 14 wherein said hydraulic fluid pumping means is a gear and said ram control means includes a switching valve.

18. The compressor of claim 14 wherein said pumping means is a piston and said ram control means is contained in said pumping means.

19. The compressor of claim 18 wherein said directional control valve includes a first connection in fluid communication with said ram chamber of said inlet compression cylinder, a second connection in fluid communication with said ram chamber of said outlet compression cylinder, a third connection in fluid communication with said hydraulic fluid pumping means, a fourth connection in fluid communication with said hydraulic fluid reservoir, a first valve position, a second valve position, a third valve position;

and said ram monitoring means includes a pressure sensing switch in electrical communication with said directional control valve and capable of sensing the hydraulic pressure in said ram chamber of said inlet compression cylinder; and a pressure sensing switch in electrical communication with said directional control valve and capable of sensing the hydraulic pressure in said ram chamber of said outlet compression cylinder.

20. The compressor of claim 19 wherein the swept volume of the compression chamber of said inlet compression cylinder is greater than the swept volume of the compression chamber of said outlet compression cylinder.

21. The compressor of claim 20 wherein said swept volume of said compression chamber of said inlet compression cylinder is four times said swept volume of said compression chamber of said outlet compression cylinder.

22. The compressor of claim 19 wherein when said directional control valve is in said first position, said hydraulic fluid pumping means pumps hydraulic fluid from said hydraulic fluid reservoir through said third and first connections to said inlet compression cylinder and returns said fluid through said second and fourth connections to said reservoir, when said directional control valve is in said second position, said hydraulic fluid pumping means pumps hydraulic fluid from said hydraulic fluid reservoir through said third and second connections to said outlet compression cylinder and returns said fluid through said first and fourth connections to said reservoir, and when said directional control valve is in said third position, said hydraulic fluid flows from said reservoir through said third and fourth connections back to said reservoir.

23. The compressor of claim 11 wherein said wellhead fluids are separated into gas, oil and water phases in said separator.

24. The compressor of claim 23 with a distribution control means for controlling the distribution of compressed gas, oil phase, and water phase to recovery lines and injection tubing without interrupting production.

25. The compressor of claim 24 wherein the distribution control means includes a spring loaded check valve to provide fluid communication between said outlet cylinder and said distribution control means when the discharge pressure of compressed gas exceeds a manually-set threshold pressure, a 3-way motor valve to provide fluid communication between said outlet cylinder and said injection tubing and said recovery lines, a gas pilot valve in gas communication with said inlet gas in said pressure vessel for controlling said 3-way motor valve, a liquid level controller for monitoring the level of said water phase in said pressure vessel, a phase level controller for monitoring the level of said oil phase in said pressure vessel, a water phase dump valve in fluid communication with said liquid level controller and said recovery lines and injection tubing, an oil phase dump valve in fluid communication with said phase level controller and said recovery lines and injection tubing, an oil phase motor valve in fluid communication with said oil phase dump valve and said recovery lines, a water phase motor valve in fluid communication with said water phase dump valve and said recovery lines, a source of instrument gas for controlling said pilot valve, dump valves, motor valves, and controllers, a manual water dump valve and an oil phase dump valve in fluid communication with said pressure vessel and with said recovery lines and injection tubing.

26. The compressor of claim 25 wherein:

said oil and gas well is injecting all of the natural gas lifted, and said oil phase and said water phase are flowing for injection, when all of said valves are closed;

said oil phase is being stored when said oil phase dump valve is open, and said water phase is being stored when said water phase dump valve is open.

27. The compressor of claim 26 wherein the pilot valve inlet of said gas pilot valve is in gas communication with said instrument gas and the pilot valve outlet of said gas pilot valve is in gas communication with the diaphragm of said 3-way motor valve such that when the flow of said instrument gas is blocked by said gas pilot valve, a first outlet of said 3-way valve is open and a second outlet is closed, but when said instrument gas is flowing through said gas pilot valve to said diaphragm of said 3-way motor valve, said second outlet of said 3-way valve is open, and said first outlet is closed.

28. The compressor of claim 25 recovering excess compressed gas and storing said oil phase and said water phase liquids when said gas pilot valve, said 3-way motor valve, said oil and water phase motor valves, and said manual dump valves are open.

29. The compressor of claim 25 injecting compressed gas and said oil phase liquids and storing said water phase liquids when said gas pilot valve, said 3-way motor valve, said oil and water phase motor valves, and said manual water phase dump valves are closed and said manual oil phase dump valve is open.

30. The compressor of claim 25 injecting compressed gas and said oil phase liquids and said water phase liquids when said gas pilot valve, said 3-way motor valve, said oil and water phase motor valves, and said manual water and water phase dump valves are closed.

31. The compressor of claim 25 wherein the composition and pressure of the wellhead fluids control production.

32. The compressor of claim 23 wherein the composition of said wellhead fluids controls the distribution of said compressed gas and oil and gas phases for recovery or injection into said well, or both.

33. The compressor of claim 11 with two compression chambers wherein said compression cylinders have a length of 108", said input compression cylinder has a diameter of 8" and its ram cylinder has a diameter of 2.375", and said outlet compression cylinder has a diameter of 4" and its ram cylinder has a diameter of 2.375" initially at 120° F. compressing inlet gas to 1000 PSIG wherein the stroke frequency is:

6.200 strokes/minute when the inlet pressure is 40 PSIG, 6.804 strokes/minute when the inlet pressure is 80 PSIG, 7.626 strokes/minute when the inlet pressure is 120 PSIG and 9.902 strokes/minute when the inlet pressure is 200 PSIG.

34. The compressor of claim 11 with two compression chambers wherein said compression cylinders have a length of 234", said input compression cylinder has a diameter of 8" and its ram cylinder has a diameter of 2.375", and said outlet compression cylinder has a diameter of 4" and its ram cylinder has a diameter of 2.375" initially at 120° F. compressing inlet gas to 210 PSIG wherein the stroke frequency is:

5.694 strokes/minute when the inlet pressure is 40 PSIG, 6.157 strokes/minute when the inlet pressure is 80 PSIG, 6.893 strokes/minute when the inlet pressure is 120 PSIG and 9.088 strokes/minute when the inlet pressure is 200 PSIG.

35. The compressor of claim 11 with two compression chambers wherein said compression cylinders have a length of 108", said input compression cylinder has a diameter of 12" and its ram cylinder has a diameter of 3.5", and said outlet compression cylinder has a diameter of 6" and its ram cylinder has a diameter of 3.5" initially at 120° F. compressing inlet gas to 1000 PSIG wherein the stroke frequency is:

4.948 strokes/minute when the inlet pressure is 40 PSIG, 5.375 strokes/minute when the inlet pressure is 80 PSIG, 6.051 strokes/minute when the inlet pressure is 120 PSIG and 8.084 strokes/minute when the inlet pressure is 200 PSIG.

36. The compressor of claim 11 with two compression chambers wherein said compression cylinders have a length of 108", said input compression cylinder has a diameter of 8" and its ram cylinder has a diameter of 2.4375", and said outlet compression cylinder has a diameter of 4" and its ram cylinder has a diameter of 2.4375" initially at 120° F. compressing inlet gas to 1000 PSIG wherein the stroke frequency is:

5.395 strokes/minute when the inlet pressure is 40 PSIG, 5.744 strokes/minute when the inlet pressure is 80 PSIG, 6.379 strokes/minute when the inlet pressure is 120 PSIG and 8.272 strokes/minute when the inlet pressure is 200 PSIG.

37. The compressor of claim 11 with three compression chambers wherein said input compression cylinder has a length of 108" and a diameter of 8" and its ram cylinder has a diameter of 2.375", and said outlet compression cylinder has a length of 96" and a diameter of 2" and its ram cylinder has a diameter of 3", and the middle compression cylinder has a length of 108" and a diameter of 4" and its ram cylinder has a diameter of 2.375" initially at 120° F. compressing inlet gas to 8000 PSIG wherein the stroke frequency is:

5.728 strokes/minute when the inlet pressure is 40 PSIG, 6.070 strokes/minute when the inlet pressure is 80 PSIG, 6.477 strokes/minute when the inlet pressure is 120 PSIG and 7.480 strokes/minute when the inlet pressure is 200 PSIG.

38. The compressor of claim 8 wherein said free-floating shafts and pistons automatically adjust their velocity and stroke distance to those required to pump fluids from said pressure vessel with said power supply.

39. The compressor of claim 8 wherein said free-floating shafts and pistons automatically adjust their reciprocating rates to those required to pump fluids from changing wellhead pressures.

40. The compressor of claim 8 wherein said free-floating shafts and pistons automatically adjust their reciprocating rates to those required to pump fluids from changing pipeline pressures.

41. The compressor of claim 8 with a power source that is external from said pressure vessel.

42. The compressor of claim 8 immersed in external fluids in a pressure vessel wherein heat generated during compression is exchanged to heat said external fluids and liquids, if any, mixed with said gasses being compressed, thereby producing heated and compressed fluids.

43. The compressor of claim 42 wherein said heated and compressed fluids are used as injection fluids to lift fluids from said oil and gas well without interrupting recovery from said well.

44. The compressor of claim 43 wherein said injection fluids are from an oil and gas well.

45. The compressor of claim 7 wherein said compression cylinders are connected serially, beginning with a first, lower pressure compression cylinder and ending with a last, higher pressure compression cylinder.

46. The compressor of claim 45 wherein the compression cylinder of the first compressing stage is in fluid communication with said natural gas from said well.

47. The compressor of claim 45 wherein the compression cylinder of the last compressing stage is in fluid communication with injection tubing in said well during injection of fluids into said well.

48. The compressor of claim 45 wherein the compression cylinder of the last compressing stage is in fluid communication with recovery lines during recovery of well fluids.

49. The compressor of claim 7 wherein said power source is an electric motor.

50. The compressor of claim 7 wherein said power source is a natural gas engine.

51. The compressor of claim 7 wherein the swept volume of the compression chamber of each of said compression cylinders decreases from that of said inlet compression cylinder to that of said outlet compression cylinder in the same order as each such compression cylinder is used sequentially in said compressor.

52. The compressor of claim 7 wherein said inlet valve monitoring means is a spring loaded inlet check valve.

53. The compressor of claim 52 wherein said spring loaded inlet check valve prevents said inlet valve from opening unless the pressure of said inlet gasses equals or exceeds the load provided by the spring in said inlet valve, thereby causing said ram control means to recycle hydraulic fluid flow back to said reservoir such that said compressor stops compressing until said pressure of said inlet gas overcomes said load provided by said spring in said inlet valve.

54. The compressor of claim 53 wherein said spring loaded inlet valve is loaded to prevent said inlet valve from opening unless the pressure of said inlet gas equals or exceeds said load provided by the spring in said inlet valve, and to switch said ram switching means to interrupt fluid flow from said reservoir to said ram chambers in said compression cylinders such that said compressor stops compressing said inlet gas when said pressure of said gas is less than said load provided by said spring in said inlet valve, and said hydraulic fluid recycles to and from said reservoir.

55. The compressor of claim 54 wherein said ram control means includes a 2-way motor valve with diaphragm in gas communication with said spring loaded inlet valve such that said 2-way motor valve is open when said inlet gas pressure is less than said load provided by said spring in said spring loaded valve and otherwise closed.

56. A lift gas injection system wherein compressed lift gas is supplied by the compressor of claim 7.

57. The compressor of claim 7 wherein said heat exchange means includes one or more of said inter-chamber fluid communication means, one or more of said compression cylinders, or any combination thereof.

58. The compressor of claim 7 wherein the rate of compression is zero when said pressure of said inlet gasses does not exceed a threshold pressure.

59. The compressor of claim 7 wherein the rate of compression and stroke frequency is influenced by the composition of said inlet fluids.

60. The compressor of claim 59 wherein the horsepower of said power supply is insufficient to pump the free-floating piston in at least one of the lower pressure cylinders through the entire available volume of said cylinder and the rate of compression and stroke frequency are controlled by said pressure of said inlet gasses.

* * * * *